US008770162B2

(12) United States Patent
Hendriksma et al.

(10) Patent No.: US 8,770,162 B2
(45) Date of Patent: Jul. 8, 2014

(54) LIFTER GUIDE ASSEMBLY FOR AN INTERNAL COMBUSTION ENGINE

(71) Applicant: GM Global Technology Operations LLC, Detroit, MI (US)

(72) Inventors: Nick John Hendriksma, Grand Rapids, MI (US); Gerald R. Stabel, Zeeland, MI (US); Kenneth J. Veenstra, Jenison, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/686,449

(22) Filed: Nov. 27, 2012

(65) Prior Publication Data

US 2014/0048028 A1 Feb. 20, 2014

Related U.S. Application Data

(60) Provisional application No. 61/684,251, filed on Aug. 17, 2012.

(51) Int. Cl.
*F01L 1/14* (2006.01)

(52) U.S. Cl.
USPC ..... 123/90.48; 123/90.38; 123/90.61; 123/193.3; 123/193.5

(58) Field of Classification Search
USPC ..... 123/90.48, 90.5, 90.38, 90.61, 193.3, 123/193.5
See application file for complete search history.

(56) References Cited

U.S. PATENT DOCUMENTS 2,465,116 A * 3/1949 Petersen ..... 123/143 A
2,975,778 A * 3/1961 Wilcox ..... 123/195 S

* cited by examiner

*Primary Examiner* — Ching Chang
(74) *Attorney, Agent, or Firm* — Cantor Colburn LLP

(57) ABSTRACT

A lifter guide includes a lifter guide body having an outer surface and an inner surface that extend from a first end to a second end. The inner surface defines at least one push rod passage. A plurality of compression members are provided at the first end. The plurality of compression members project proudly from the first end. The plurality of compression members are configured and disposed to be compressed by a cylinder head to retain the lifter guide in a cylinder block. The lifter guide is devoid of mechanical fasteners.

26 Claims, 6 Drawing Sheets

LIFTER GUIDE ASSEMBLY FOR AN INTERNAL COMBUSTION ENGINE

CROSS-REFERENCE TO RELATED APPLICATION

This application claims priority of U.S. Provisional Patent Application Ser. No. 61/684,251, filed Aug. 17, 2012, which is incorporated herein by reference in its entirety.

FIELD OF THE INVENTION

The subject invention relates to the art of internal combustion engines and, more particularly, to a lifter guide assembly for an internal combustion engine.

BACKGROUND

Internal combustion engines include pistons that travel within a cylinder. A combustible mixture of fuel and air enters the cylinder through an intake valve provided in a cylinder head. The piston moves toward the cylinder head compressing the combustible mixture. A spark ignites the combustible mixture causing the piston to travel along the cylinder away from the cylinder head imparting a force to a crankshaft. The crankshaft transmits an output to, for example, a vehicle drivetrain. The piston again travels toward the cylinder head driving exhaust gases through an exhaust valve.

Opening and closing of the intake valve and exhaust valve is controlled by a camshaft. Lifters travel along lobes of the camshaft imparting a reciprocating motion to respective ones of the intake valve and the exhaust valve. Generally, the lifters urge push rods into contact with rockers. The rockers selectively open and close respective ones of the intake valve and exhaust valve. In certain cases, the lifter includes rollers that ride on the lobes of the camshaft. The lifters are held in place by lifter guides that establish a desired orientation of the rollers relative to the lobes of the camshaft. The lifter guides also aid in assembly of the internal combustion engine.

Presently, the lifter guides are held in place in the engine block using one or more mechanical fasteners. In certain cases, the mechanical fasteners are held in place on the lifter guide by retaining fingers. The mechanical fasteners are tightened during assembly. The use of mechanical fasteners increases an overall cost of the lifter guide as well as adds increased time and complexity to an overall process for manufacturing an internal combustion engine. Accordingly, it is desirable to provide a lifter guide that may be installed without the need for mechanical fasteners.

SUMMARY OF THE INVENTION

In one exemplary embodiment, a lifter guide includes a lifter guide body having an outer surface and an inner surface that extend from a first end to a second end. The inner surface defines at least one push rod passage. A plurality of compression members are provided at the first end. The plurality of compression members projecting proudly from the first end. The plurality of compression members are configured and disposed to be compressed by a cylinder head to retain the lifter guide in a cylinder block. The lifter guide is devoid of mechanical fasteners.

In another exemplary embodiment, an internal combustion engine includes a cylinder block having a deck face and at least one lifter guide receiving portion defined in the deck face, and a cylinder head mounted to the cylinder block at the deck face. A lifter guide is arranged in the lifter guide receiving portion. The lifter guide includes a lifter guide body including an outer surface and an inner surface that extend from a first end to a second end. The inner surface defines at least one push rod passage. A plurality of compression members are provided at the first end. The plurality of compression members project proudly relative to the deck face at the first end. The plurality of compression members is compressed by the cylinder head to retain the lifter guide in the cylinder block. The lifter guide being devoid of mechanical fasteners.

In yet another exemplary embodiment, a method of installing a lifter guide in an internal combustion engine includes inserting a lifter guide into a lifter guide receiving portion formed in a cylinder block having a deck surface, mounting a cylinder head to the deck surface of the cylinder block, and compressing a plurality of compression members that project from the lifter guide proudly relative to the deck surface with the cylinder head to retain the lifter guide in the lifter guide receiving portion without a mechanical fastener.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
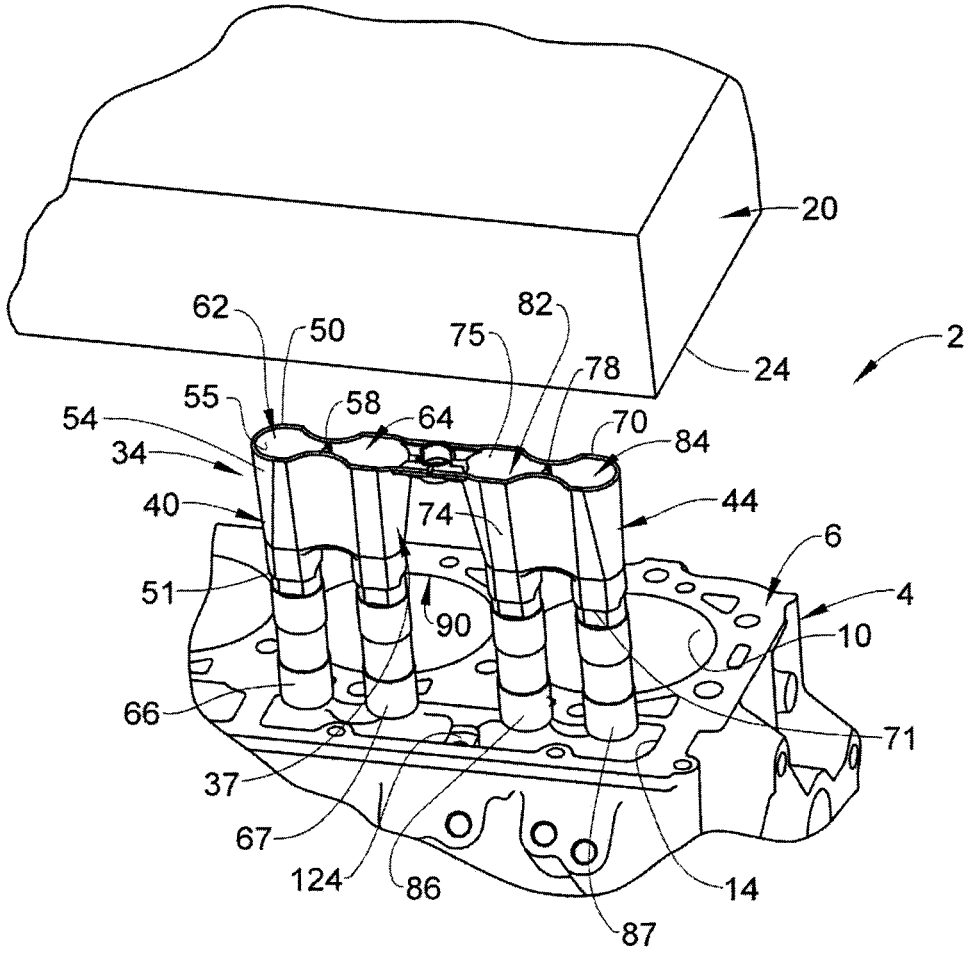
FIG. 1 is a partial perspective view of an internal combustion engine including an engine block and a lifter guide in accordance with an exemplary embodiment.

The following description is merely exemplary in nature and is not intended to limit the present disclosure, its application or uses. It should be understood that throughout the drawings, corresponding reference numerals indicate like or corresponding parts and features.

An internal combustion engine constructed in accordance with an exemplary embodiment is indicated generally at 2 in FIG. 1. Internal combustion engine 2 includes a cylinder block 4 having a deck surface 6. A plurality of cylinders, one of which is indicated at 10, extend through cylinder block 4 and are exposed at deck surface 6. Cylinder block 4 is also shown to include a plurality of lifter guide receiving portions, one of which is indicated at 14 and a cylinder head 20 having a block surface 24. Cylinder head 20 is connected to cylinder block 4 with block surface 24 being supported at deck surface 6. Generally, a head gasket (not shown) is positioned between deck surface 6 and cylinder head 20. The head gasket prevents the escape of coolant, lubricant, and/or combustion gases from cylinder block 4 and cylinder head 20. Prior to installation of cylinder head 20, a lifter guide 34 is positioned in lifter guide receiving portion 14. Additional lifter guides (not shown) are provided in others of the lifter guide receiving portions (not separately labeled).

Figure 2:
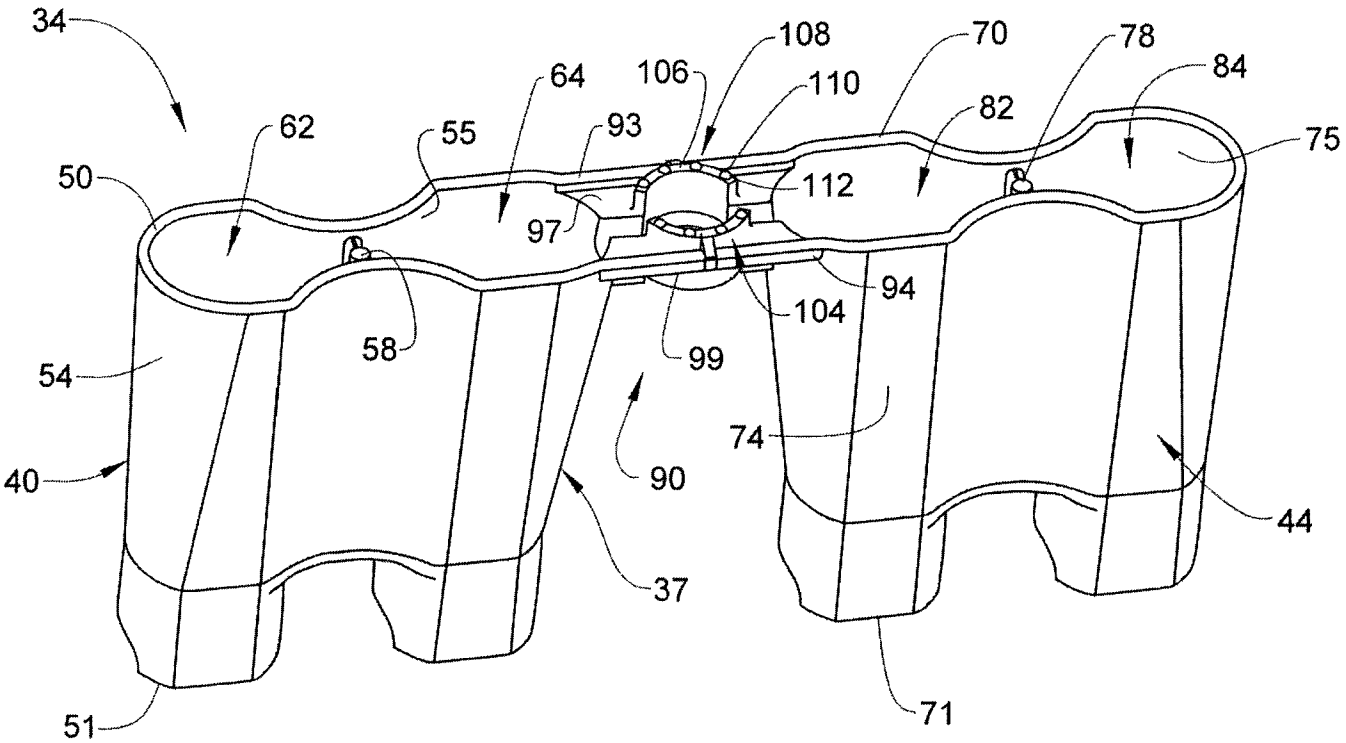
FIG. 2 is a perspective view of the lifter guide of FIG. 1.

In accordance with an exemplary embodiment illustrated in FIG. 2, lifter guide 34 includes a lifter guide body 37 formed from, for example, glass filled nylon. Lifter guide body 37 includes a first body portion 40 and a second body portion 44. First body portion 40 includes a first end 50 that extends to a second end 51. First body portion 40 also includes an outer surface 54 and an inner surface 55. A divider 58 is connected to inner surface 55 defining a first push rod passage 62 and a second push rod passage 64. First body portion 40 supports and establishes a desired orientation for first and second lifters 66 and 67 (FIG. 1). First and second lifters 66 and 67 are mounted to second end 51 of first body portion 40. Second body portion 44 includes a first end 70 that extends to a second end 71. Second body portion 44 also includes an outer surface 74 and an inner surface 75. A divider 78 is connected to inner surface 75 defining a third push rod passage 82 and a fourth push rod passage 84. Second body portion 44 supports and establishes a desired orientation for third and fourth lifters 86 and 87 (FIG. 1). In a manner similar to that described above, third and fourth lifters 86 and 87 are mounted to second end 71 of second body portion 44. Lifters 66, 67 and 86, 87 transmit rotary motion from a camshaft (not shown) into a linear motion that is guided to structure in cylinder head 20 through a number of push rods (also not shown).

In further accordance with the exemplary embodiment shown, lifter guide 34 includes a linking bridge 90 connecting first and second body portions 40 and 44. Linking bridge 90 includes a first end portion 93 that extends from first end 50 of first body portion 40 to a second end portion 94 that connects with first end 70 of second body portion 44. Linking bridge 90 also includes a first surface 97 and a second, opposing surface 99. First surface 97 includes a central raised portion 104 having an upper edge 106. Upper edge 106 is provided with a plurality of compression members, one of which is indicated at 108. Compression members 108 take the form of raised bumps 110 having a generally circular edge 112 that are integrally formed with lifter guide 34. Of course, it should be understood that compression members 108 may take on a variety of forms. Compression members 108 are acted upon by cylinder head 20 to located lifter guide 34 in lifter guide receiving portion 14. Compression members 108 may be sized to accommodate dimensional variations in one or more of cylinder block 4, cylinder head 20 and/or lifter guide 34 to ensure a desired fit. In addition, compression members 108 are sized so as to deform/crush without having a negative effect on structural integrity of lifter guide 34.

Figure 3:
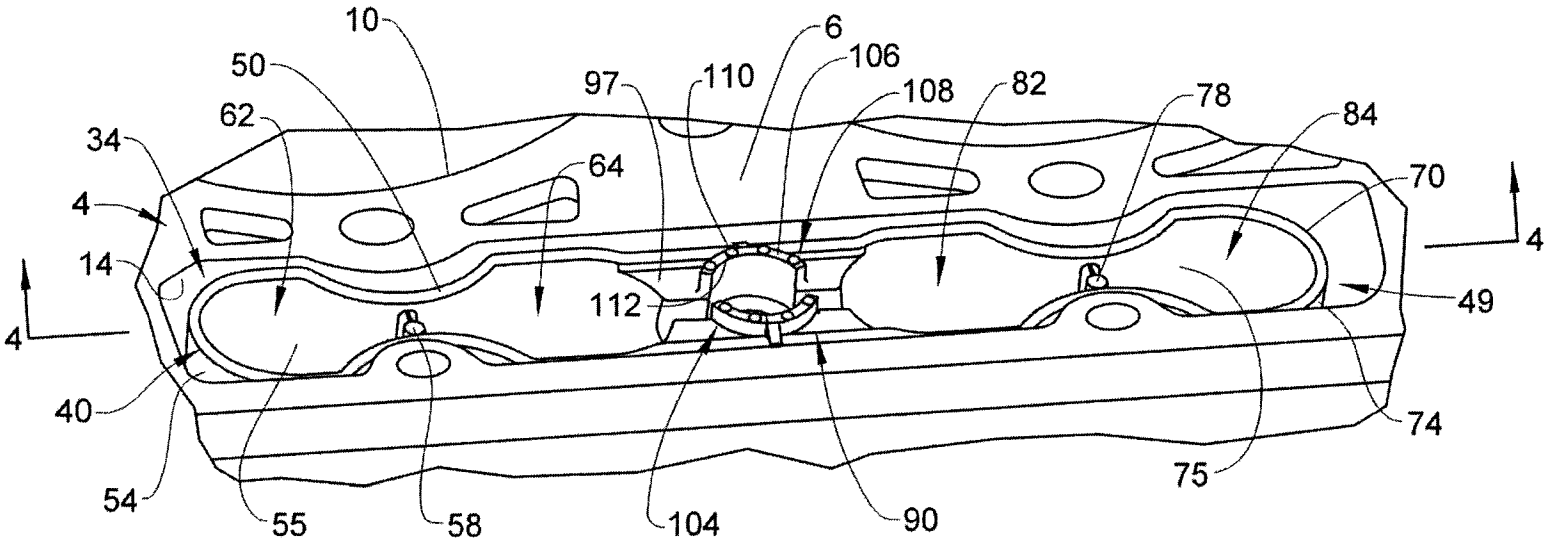
FIG. 3 is a partial perspective view of the lifter guide of FIG. 2 installed into the engine block of FIG. 1.
Figure 4:
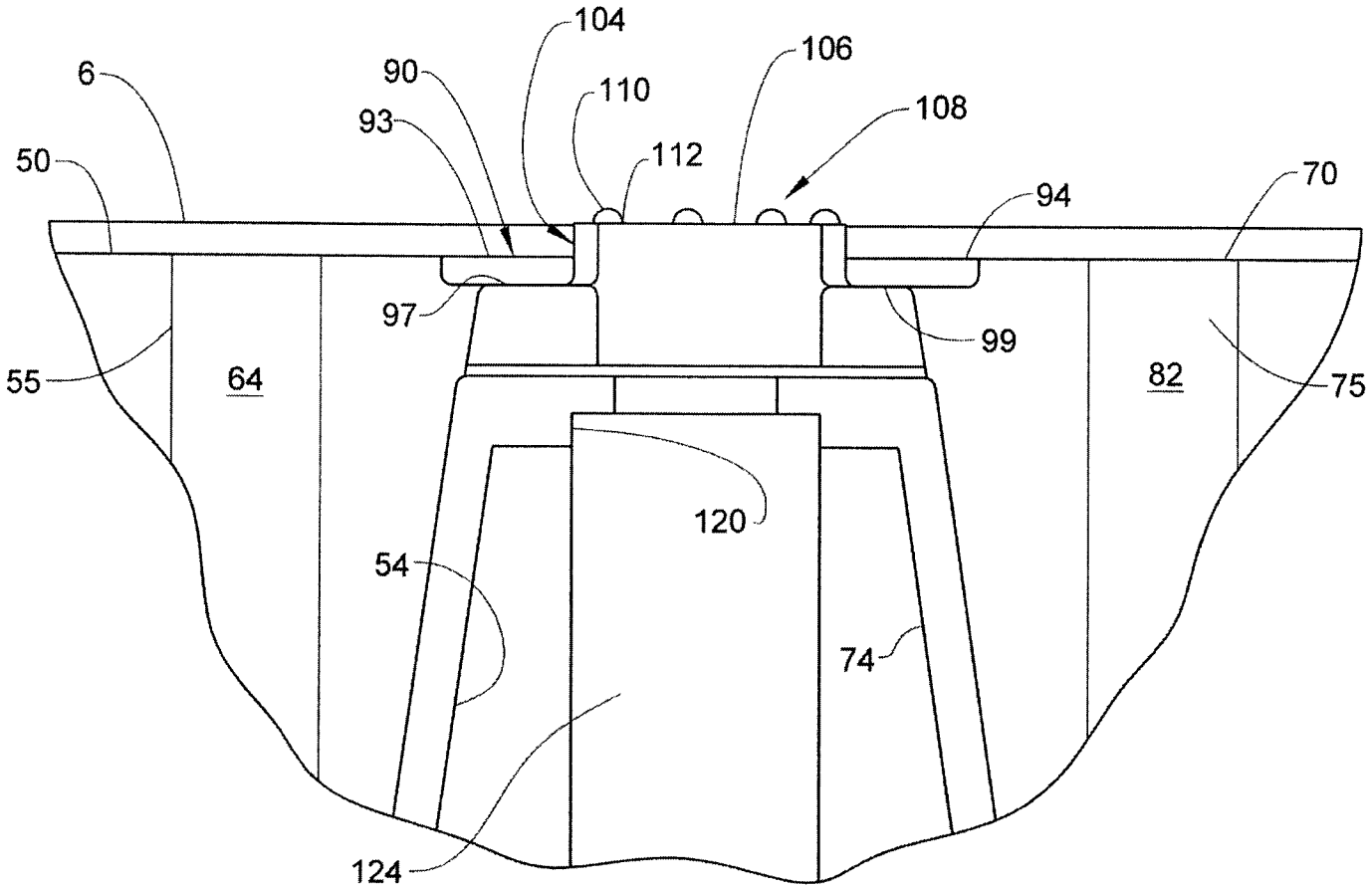
FIG. 4. is a cross-sectional side view of the lifter guide installed in the engine block of FIG. 3.

As best shown in FIGS. 3 and 4, lifter guide 34 is inserted into lifter guide receiving portion 14. Once inserted, compression members 108 project proudly relative to deck surface 6. Lifter guide 34 is also shown to include a recessed portion 120 formed in second surface 99 of linking bridge 90. Recessed portion 120 receives a mounting post 124 that projects through lifter guide receiving portion 14 thereby establishing a desired longitudinal and transverse position of lifter guide 34 prior to assembly of cylinder head 20. At this point, cylinder head 20 is mounted to deck surface 6. Cylinder head 20 contacts and crushes/deforms compression members 108. The deformation of compression members 108 fix lifter guide 34 in lifter guide receiving portion 14 without the need for a mechanical fastener.

Figure 5:
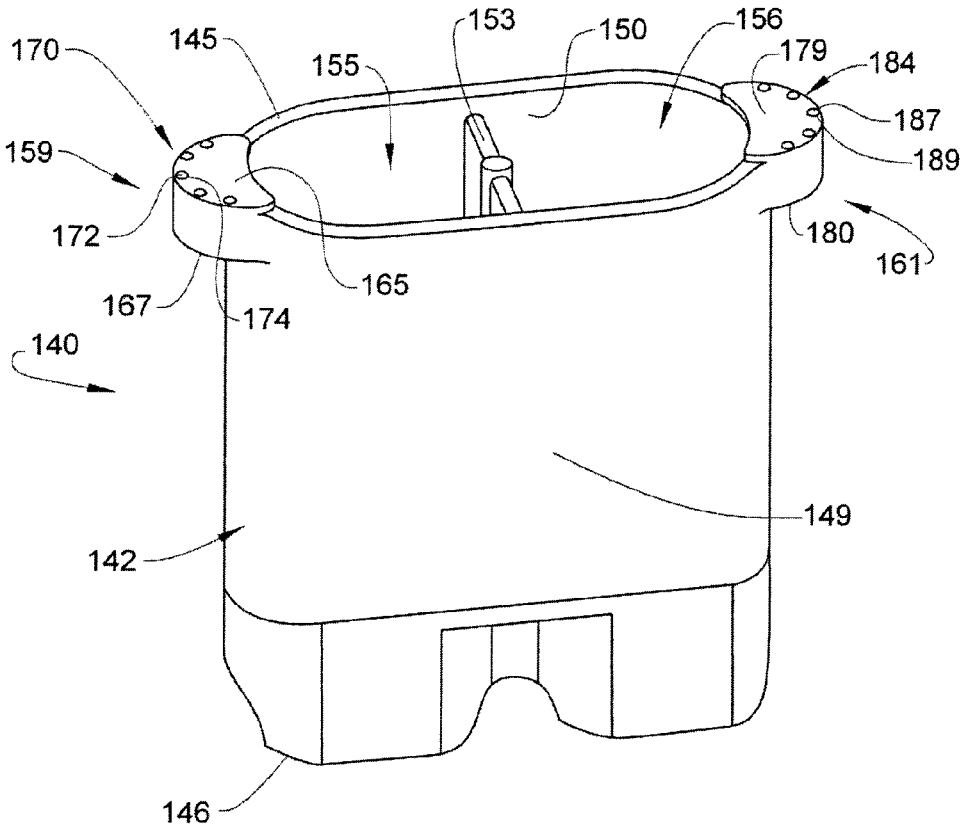
FIG. 5 is a perspective view of a lifter guide in accordance with another aspect of an exemplary embodiment.

Reference will now follow to FIG. 5 in describing a lifter guide 140 in accordance with another aspect of the exemplary embodiment. Lifter guide 140 includes a lifter guide body 142 formed from, for example, glass filled nylon. Lifter guide 140 includes a first end 145 that extends to a second end 146. Lifter guide body 142 includes an outer surface 149 and an inner surface 150. A divider 153 extends across inner surface 150 defining first and second push rod passages 155 and 156. Lifter guide 140 includes a first flange portion 159 projecting outward from first end 145 at first push rod passage 155 and a second flange portion 161 that extends outward from second end 146 at second push rod passage 156.

Figure 6:
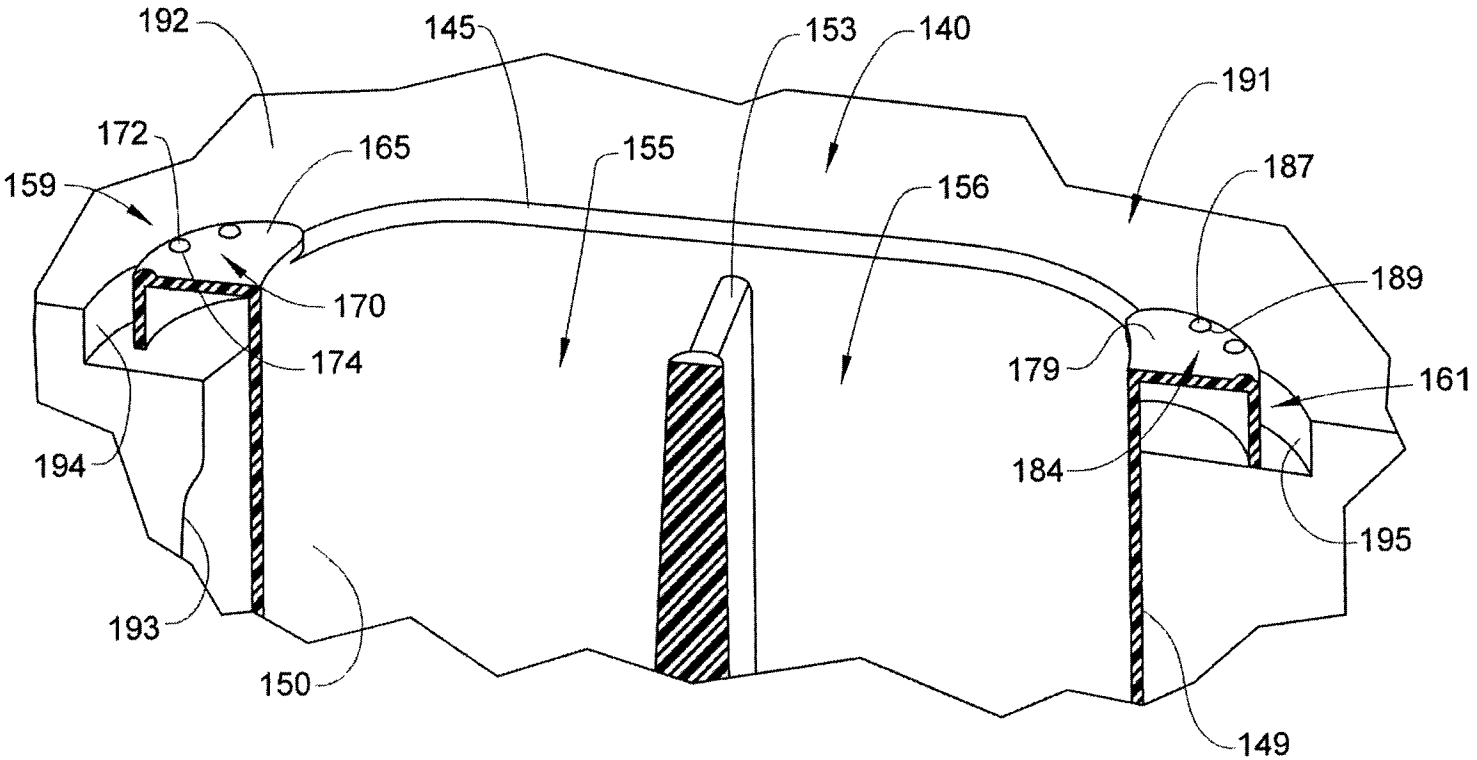
FIG. 6 is a cross-sectional partial perspective view of the lifter guide of FIG. 5 installed in an engine block.

First flange portion 159 includes a first surface portion 165 and an opposing second surface portion 167. First surface portion 165 includes a plurality of compression members 170. In the exemplary embodiment shown, compression members 170 take the form of raised bumps 172 having a generally circular edge 174 integrally formed with lifter guide 140. Of course, it should be understood that compression members 170 may take on a variety of forms. Similarly, second flange portion 161 includes a first surface portion 179 and an opposing second surface portion 180. First surface portion 179 includes a plurality of compression members 184. In the exemplary embodiment shown, compression members 184 take the form of raised bumps 187 having a generally circular edge 189. Of course, as discussed above, it should be understood that compression members 184 may take on a variety of forms As shown in FIG. 6, lifter guide 140 is positioned within a cylinder block 191 having a deck surface 192. Specifically, lifter guide 140 is positioned in a lifter guide receiving portion 193 formed in cylinder block 191 and exposed at deck surface 192. Lifter guide receiving portion 193 includes first and second recesses 194 and 195 that are configured to receive first and second flange portions 159 and 161 and establish a desired longitudinal and transverse position of lifter guide 140 prior to assembly of a cylinder head (not shown). Recesses 194 and 195 position first and second flange portions 159 and 161 such that compression members 170 and 184 project proudly relative to deck surface 192. As discussed above, a cylinder head (not shown) is mounted to cylinder block 191. The cylinder head crushes or deforms compression members 170 and 184 locking lifter guide 140 to cylinder block 191.

At this point it should be understood that the exemplary embodiments provide a system for installing lifter guides in a cylinder block without the need for mechanical fasteners. Eliminating mechanical fasteners advantageously reduces parts costs, eliminates manufacturing steps and reduces part complexity. In addition, the lifter guides of the exemplary embodiments can be mated with lifters to provide a single assembly that may be installed into a cylinder block. It should also be understood that the number, arrangement, and geometry of the compression members may vary. Further while described as being formed from glass filled nylon, it should be understood that the lifter guide may be formed from other materials. Also, while described as being integrally formed with the lifter guide, the compression members may be distinct structures that are later added. The compression members may be formed from the same material as the lifter guide or may be formed from a different material.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A lifter guide comprising:

a lifter guide body including an outer surface and an inner surface that extend from a first end to a second end, the inner surface defining at least one push rod passage;

a plurality of compression members provided at the first end, the plurality of compression members projecting proudly from the first end, the plurality of compression members being configured and disposed to be compressed by a cylinder head to retain the lifter guide in a cylinder block, the lifter guide being devoid of mechanical fasteners.

2. The lifter guide according to claim 1, wherein the lifter guide body includes a first body portion and a second body portion, the at least one push rod passage including first and second push rod passages provided in the first body portion, third and fourth push rod passages provided in the second body portion, the first body portion being joined to the second body portion through a linking bridge.

3. The lifter guide according to claim 2, wherein the linking bridge includes a first surface and an opposing second surface, the plurality of compression members being provided on first surface of the linking bridge.

4. The lifter guide according to claim 3, wherein the first surface of the linking bridge includes a central raised portion, the plurality of compression members being provided on the central raised portion.

5. The lifter guide according to claim 3, wherein the second surface of the linking bridge includes a recessed portion configured and disposed to receive a mounting post.

6. The lifter guide according to claim 1, wherein the at least one push rod passage includes a first push rod passage and a second push rod passage extending through the lifter guide body, the first push rod passage being separated from the second push rod passage by a divider.

7. The lifter guide according to claim 6, wherein the lifter guide body includes at least one flange portion extending radially from the outer surface, the plurality of compression members being provided on the at least one flange portion.

8. The lifter guide according to claim 7, wherein the at least one flange portion includes a first flange portion positioned adjacent the first push rod passage, and a second flange portion positioned adjacent the second push rod passage.

9. The lifter guide according to claim 8, wherein the plurality of compression members are provided on each of the first and second flange portions.

10. The lifter guide according to claim 1, wherein each of the plurality of compression members comprise a raised bump.

11. The lifter guide according to claim 10, wherein the raised bump includes a generally circular edge.

12. The lifter guide according to claim 10, further comprising: a lifter provided at the second end.

13. An internal combustion engine comprising:

a cylinder block including a deck face and at least one lifter guide receiving portion defined in the deck face;

a cylinder head mounted to the cylinder block at the deck face; and a lifter guide arranged between in the lifter guide receiving portion, the lifter guide includes:

a lifter guide body including an outer surface and an inner surface that extend from a first end to a second end, the inner surface defining at least one push rod passage;

a plurality of compression members provided at the first end, the plurality of compression members projecting proudly relative to the deck face at the first end, the plurality of compression members being compressed by the cylinder head to retain the lifter guide in the cylinder block, the lifter guide being devoid of mechanical fasteners.

14. The internal combustion engine according to claim 13, wherein the lifter guide body includes a first body portion and a second body portion, the at least one push rod passage including first and second push rod passages provided in the first body portion, third and fourth push rod passages provided in the second body portion, the first body portion being joined to the second body portion through a linking bridge.

15. The internal combustion engine according to claim 14, wherein the linking bridge includes a first surface and an opposing second surface, the plurality of compression members being provided on first surface of the linking bridge.

16. The internal combustion engine according to claim 15, wherein the first surface of the linking bridge includes a central raised portion, the plurality of compression members being provided on the central raised portion.

17. The internal combustion engine according to claim 15, wherein the second surface of the linking bridge includes a recessed portion configured and disposed to receive a mounting post.

18. The internal combustion engine according to claim 13, wherein the at least one push rod passage includes a first push rod passage and a second push rod passage extending through the lifter guide body, the first push rod passage being separated from the second push rod passage by a divider.

19. The internal combustion engine according to claim 18, wherein the lifter guide body includes at least one flange portion extending radially from the outer surface, the plurality of compression members being provided on the at least one flange portion.

20. The internal combustion engine according to claim 19, wherein the at least one flange portion includes a first flange portion positioned adjacent the first push rod passage, and a second flange portion positioned adjacent the second push rod passage.

21. The internal combustion engine according to claim 20, wherein the plurality of compression members are provided on each of the first and second flange portions.

22. The internal combustion engine according to claim 13, wherein each of the plurality of compression members comprise a raised bump.

23. The internal combustion engine according to claim 22, wherein the raised bump includes a generally circular edge.

24. The internal combustion engine according to claim 13, further comprising: a lifter provided at the second end.

25. A method of installing a lifter guide in an internal combustion engine, the method comprising:

inserting a lifter guide into a lifter guide receiving portion formed in a cylinder block having a deck surface;

mounting a cylinder head to the deck surface of the cylinder block; and compressing a plurality of compression members that project from the lifter guide proudly relative to the deck surface with the cylinder head to retain the lifter guide in the lifter guide receiving portion without a mechanical fastener.

26. The method of claim 25, wherein compressing the plurality of compression members include deforming a plurality of raised bumps provided on the lifter guide.

* * * * *